US011315397B2

(12) United States Patent
Bella et al.

(10) Patent No.: US 11,315,397 B2
(45) Date of Patent: Apr. 26, 2022

(54) ANTI-TAMPERING ASSEMBLY AND SYSTEM

(71) Applicant: TELECOM ITALIA S.p.A., Milan (IT)

(72) Inventors: Valter Bella, Turin (IT); Fabio Bellifemine, Milan (IT); Laura Contin, Turin (IT); Rossana Simeoni, Turin (IT)

(73) Assignee: TELECOM ITALIA S.p.A., Milan (IT)

( * ) Notice: Subject to any disclaimer, the term of this patent is extended or adjusted under 35 U.S.C. 154(b) by 0 days.

(21) Appl. No.: 16/622,613

(22) PCT Filed: Jun. 20, 2018

(86) PCT No.: PCT/EP2018/066364
§ 371 (c)(1),
(2) Date: Dec. 13, 2019

(87) PCT Pub. No.: WO2018/234357
PCT Pub. Date: Dec. 27, 2018

(65) Prior Publication Data

US 2021/0142631 A1 May 13, 2021

(30) Foreign Application Priority Data

Jun. 23, 2017 (IT) ..... 102017000070232

(51) Int. Cl.
*G08B 13/12* (2006.01)
*B65D 55/02* (2006.01)
*G08B 13/24* (2006.01)

(52) U.S. Cl.
CPC ..... *G08B 13/126* (2013.01); *B65D 55/02* (2013.01); *G08B 13/2417* (2013.01); *G08B 13/2448* (2013.01)

(58) Field of Classification Search
CPC ..... G06K 19/0723; G06K 19/07345; G06K 19/07749; G06K 19/07758;
(Continued)

(56) References Cited

U.S. PATENT DOCUMENTS

2004/0066296 A1* 4/2004 Atherton ..... G08B 13/1445 340/572.1
2009/0189763 A1* 7/2009 Brinkley ..... G08B 25/10 340/541
(Continued)

FOREIGN PATENT DOCUMENTS

CN 2781472 Y 5/2006
CN 1991871 A 7/2007
CN 106251534 A 12/2016

OTHER PUBLICATIONS

International Search Report dated Jul. 31, 2018 in PCT/EP2018/066364 filed on Jun. 20, 2018.
(Continued)

*Primary Examiner* — Mirza F Alam
(74) *Attorney, Agent, or Firm* — Oblon, McClelland, Maier & Neustadt, L.L.P.

(57) ABSTRACT

It is disclosed an anti-tampering assembly for the transportation and storage of a package, the anti-tampering assembly being configured to be associated with the package. the anti-tampering assembly comprises: a tampering detection unit comprising a RFID passive tag and a tampering track of a conductive material configured to be connected to said RFID tag upon dispatching the package so as to inhibit the operation of the RFID tag, wherein the tampering track is configured to be interrupted in case of tampering of the package; an actuating unit configured to detect the interruption of the tampering track in case of tampering of the package and, upon detection, actuate an alarm unit; and the alarm unit comprising a radio module configured to, upon
(Continued)

actuation, transmit an alarm message over a long range wireless communication network.

17 Claims, 4 Drawing Sheets

(58) Field of Classification Search
CPC ..... G06K 19/07798; G06K 7/10366; G09F 2003/0273; G09F 3/0329
See application file for complete search history.

(56) References Cited

U.S. PATENT DOCUMENTS

| | | | | |
|---|---|---|---|---|
| 2010/0097215 | A1 | 4/2010 | Locher | |
| 2012/0218110 | A1 | 8/2012 | Forster | |
| 2013/0342394 | A1* | 12/2013 | Leslie | G08B 21/0261 342/357.31 |
| 2017/0058565 | A1* | 3/2017 | Sanchez | A61J 1/00 |
| 2017/0117431 | A1* | 4/2017 | Afzali-Ardakani | H01L 31/02019 |

OTHER PUBLICATIONS

Combined Chinese Office Action and Search Report dated Feb. 26, 2021 in Chinese Patent Application No. 201880038024.2 (with English translation), 18 pages.

* cited by examiner

ANTI-TAMPERING ASSEMBLY AND SYSTEM

TECHNICAL FIELD

The present invention relates to the field of goods transportation and storage. In particular, the present invention relates to an anti-tampering assembly and an anti-tampering system for the secure transportation and storage of goods, such as, for instance, electronic devices and pharmaceutical products.

BACKGROUND ART

It is known to trace the transportation of packages and goods contained therein by tracking their position and the identity of people (e.g. operators of the logistics service provider, carriers and the like) who are in charge of handling them while being transported to their destination.

It is also known to track other information such as temperature, humidity, acceleration and brightness inside the package to check the integrity of goods and possible tampering. Indeed, too high temperature or humidity values may deteriorate the goods, and an unusual value of acceleration may indicate that the package is falling down from its position or is being hit. A sudden increase in the brightness value inside the package may indicate that the package has been opened: if opening happens in a not expected position or in a not expected date and time of the day, it may indicate that the package is being fraudulently tampered.

US 2004/0066296 discloses a tamper indicating label that may include RFID components and a tamper track coupled to the RFID components. The tamper track should be constructed from a destructible conducting path. Additionally, the tamper track can be formed such that it is damaged when the label is tampered. In one embodiment, adhesion characteristics of the tamper track are adapted to break apart the tamper track when the label is tampered, for example, by removal from an object. The RFID components may retain their RF capability and detect when the tamper track has been damaged to indicate that the label has been tampered. Alternatively, the RFID capability of the RFID components may be disabled when the tamper track is damaged, indicating tampering.

US 2010/0097215 discloses a security material having a web-like interlaced fabric and insulated, electrically conductive wires integrated therein. Provision is made for a first wire to be arranged in the longitudinal direction of the web-like interlaced fabric and for a second wire to extend in a meandering manner across the width of the web-like interlaced fabric in the longitudinal direction thereof.

SUMMARY OF THE INVENTION

The Applicant has noticed that the systems and devices cited above have some drawbacks.

In particular, known devices capable of tracking the brightness inside a package and send an alarm if a sudden change in the brightness value happens typically comprise rather complex sensors and circuitries. These devices are hence bulky. They also need to be supplied with electricity by a battery, whose charge has a limited duration (usually from one day to a few weeks, according to the amount of data being transmitted by the radio module). Moreover, the devices cited above are costly. Hence, typically, they are used many times, which may cause problems in handling the devices by the logistics service providers: they typically prefer disposable devices in order not to arrange a dedicated transportation for sending them back to the owners.

US 2004/0066296 discloses that if a tamper track is disrupted through the RFID label being tampered, or if connection between the tamper track and the conducting path on the object is broken, the RFID function of the label may be modified to indicate tampering, and this information can be detected by an RFID reader. However, the Applicant noticed that detection of the tampering event is provided when the modified RFID label is read by an RFID reader. This may happen after a certain time interval has passed from the tampering event and may not guarantee a timely intervention to prevent violations. Moreover, data stored in the RFID label of US 2004/0066296 are always readable by an RFID reader, whether or not the package carrying the RFID label has been tampered. This may represent a drawback in case the owner of the transported object wishes to maintain secrecy about the safety measures caring for the value of the object during its transportation to destination.

According to US 2010/0097215, the wires may be electrically connected to a measurement electronics. Through analysis of the resistance or of the chronological variation of the conductivity of the two series-connected wires it can be established whether the two wires are intact or have been severed. However, the Applicant has noticed that using the security material of US 2010/0097215 for packaging goods does not guarantee a timely intervention against a violation of the goods.

In view of the above, the Applicant has tackled the problem of providing an anti-tampering assembly and an anti-tampering system for the transportation and storage of goods, which allow to overcome at least one of the drawbacks outlined above. In particular, the Applicant has tackled the problem of providing an anti-tampering assembly and an anti-tampering system for the transportation and storage of goods, which allow monitoring, in a complete and reliable way, the integrity of the goods' package, and which in particular allow to timely generate an alarm in case a tampering event is detected, without requiring complex and/or costly circuitries.

According to the invention, the problem above is solved by an anti-tampering system providing an anti-tampering service to users wishing to secure transportation and storage of goods. The system comprises an anti-tampering assembly to be put inside the package carrying the goods. In case of a tampering event, the anti-tampering assembly is capable of detecting it in real time, and sending an alarm trough a wireless communication network to a server, the alarm providing information about when and where the tampering event occurred, so that this information may be made available to the operators of a logistics service provider who may take consequent actions.

In the following description and in the claims, the expression "logistics service provider" will indicate a company or entity that manages the shipping of goods between points of origin to end-use destinations. It typically handles packaging, inventory, warehousing and shipping functions for the delivery of the goods. The operators of the logistics service provider are meant to be the persons in charge of the operations above. In the following description, the term "carrier" will indicate a company or entity, and any operator thereof, that transports the goods by air, land, or sea.

According to a first aspect, the present invention provides an anti-tampering assembly for the transportation and storage of a package, the anti-tampering assembly being configured to be associated with said package, the anti-tampering assembly comprising:

a tampering detection unit comprising a RFID passive tag and a tampering track of a conductive material configured to be connected to the RFID tag upon dispatching the package so as to inhibit the operation of the RFID tag, wherein the tampering track is configured to be interrupted in case of tampering of the package;

an actuating unit configured to detect the interruption of the tampering track in case of tampering of the package and, upon detection, actuate an alarm unit; and the alarm unit comprising a radio module configured to, upon actuation of the alarm unit, transmit an alarm message over a long range wireless communication network.

Preferably, the RFID passive tag is a NFC passive tag.

Preferably, the package is a box and the tampering track is a conductive track of a conductive ink to be printed on the inner surfaces of the box.

Preferably, the RFID passive tag comprises an antenna and a memory configured to store a unique identifier associated with the RFID passive tag, wherein the tampering track is configured to, when the anti-tampering assembly is associated with the package, short-circuit said antenna.

Preferably, the RFID passive tag of the tampering detection unit, the actuating unit and the alarm unit are housed in an anti-tampering device comprising a battery.

Preferably, the anti-tampering device is in the form of a label to be applied on an inner surface of the box.

According to embodiments of the present invention, the anti-tampering device further comprises two pairs of Schottky diodes interposed in a bridge configuration between the tampering track and the RFID passive tag, and connected to the battery.

Preferably, the actuating unit comprises an N-MOSFET transistor whose gate is configured to be connected to the tampering track, and an opto-isolator connected to the N-MOSFET transistor and to the radio module.

Preferably, the radio module comprises an integrated circuit storing an identity number to identify the anti-tampering assembly over the long range wireless communication network, and a baseband module configured to store data of at least one pre-defined contact entity, wherein the radio module is configured to, in case of tampering of the package, send an alarm message to the at least one pre-defined contact entity.

Preferably, the alarm message comprises the identity number of the radio module, localization data indicating a current location of the package and time data indicating a date and a time of the day at which the alarm message is sent.

According to embodiments of the present invention, the anti-tampering assembly further comprises a tracking label comprising a further RFID passive tag, the further RFID passive tag being associated with a further unique identifier.

According to embodiments of the present invention, the package is a fabric bag or pouch, and the tampering track is an electrically conductive thread of the fabric.

According to a second aspect, the present invention provides an anti-tampering system for the transportation and storage of a package, the anti-tampering system comprising an anti-tampering assembly configured to be associated with the package as set forth above, and a server connected to the anti-tampering assembly over a long range wireless communication network, the server being configured to cooperate with a database configured to store a shipping record associated with the transportation and storage of the package, the system further comprising an anti-tampering application configured to be installed on a gateway device able to connect to the long range wireless communication network for interacting with the server.

Preferably, the shipping record comprises the unique identifier associated with the RFID passive tag, the further unique identifier associated with the further RFID passive tag, the identity number of the radio module and a shipping identifier associated with the package.

Preferably, the database is configured to store a list of authorized identity numbers associated with a number of gateway devices authorized to handle the transportation and storage of the package.

BRIEF DESCRIPTION OF THE DRAWINGS

The present invention will become clearer from the following detailed description, given by way of example and not of limitation, to be read with reference to the accompanying drawings, wherein.

DETAILED DESCRIPTION OF PREFERRED EMBODIMENTS OF THE INVENTION

Figure 1:
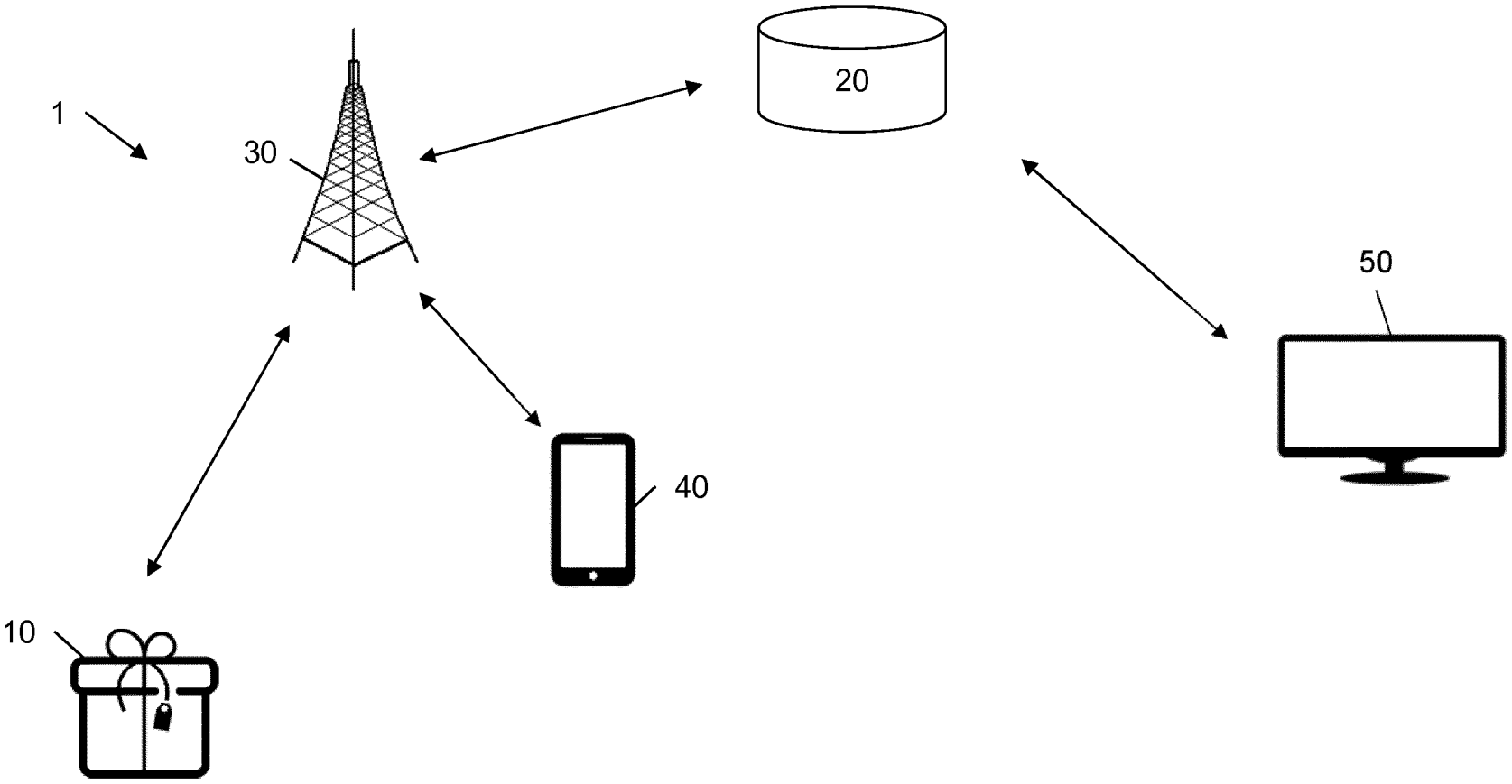
FIG. 1 schematically shows an anti-tampering system according to embodiments of the present invention.

FIG. 1 schematically shows an anti-tampering system 1 according to embodiments of the present invention. The anti-tampering system 1 preferably provides to users an anti-tampering service to secure transportation and storage of goods. Users of the anti-tampering service according to the present invention may be individuals whishing to secure shipping of goods, and companies providing transportation and tracking services, such as logistics service providers and carriers.

In particular, the anti-tampering system 1 may be used by a logistics service provider for monitoring the integrity of a package during transportation and storage, from a point of origin, where the package is assembled, to an end-use destination. Moreover, the anti-tampering system 1 of the present invention may be employed by a user whishing to secure transportation and storage of goods, the user being either the sender of the goods or the goods recipient.

An exemplary use case in which the system of the present invention may be employed is for securing the transportation of goods that a user buys on an e-commerce website, whose transportation and storage is managed by a logistics service provider. Both the logistics service provider and the end user shall register to the anti-tampering service provided by the system 1, as it will be described herein after.

The system 1 preferably comprises an anti-tampering assembly configured to be associated with a box 10 for the goods' transportation and storage, and a server 20 (e.g., a cloud server), which is able to connect to the anti-tampering assembly through a long range wireless communication network 30 (represented in FIG. 1 by a base station, for simplicity, and indicated in the following description simply as "wireless communication network 30"). The server 20 preferably cooperates with a database configured to store records associated with the shipping events handled by the logistics service provider registered to the anti-tampering service. The database may be physically co-located with a server apparatus or it may be a distributed (cloud) database.

The system 1 preferably also comprises a software application with a corresponding user interface, which may be installed on a gateway device 40 (in particular, a portable device such as, for instance, a smartphone, a tablet or the like) able to connect to the wireless communication network 30 for interacting with the server 20, and also capable to connect to the anti-tampering assembly via a short-range communication link, as it will be described herein after. The software application will be indicated as "anti-tampering application".

Further, the system 1 may comprise a web application with a user interface (e.g. a dashboard) running in a web browser, which may be accessed and used by an operator at a logistics control center 50 of the logistics service provider by means of an apparatus such as a PC, a tablet, a smartphone, or the like.

The wireless communication network 30 is preferably a cellular communication network and it may be, for instance, a GSM (Global System for Mobile Communications) network, a 3G network, a 4G network, an LTE (Long Term Evolution) network, etc. The wireless communication network 30 may also be a Wi-Fi network. The server 20 and the apparatuses on which the web application may be used (e.g., the apparatuses of the logistics control center 50) may be connected by means of wireless or wired data links supporting the Internet protocol. Wired links may be ADSL (Asymmetric Digital Subscriber Line) links or optic fiber links.

The anti-tampering assembly, according to the present invention, comprises an RFID (Radio Frequency Identification) passive tag storing a unique identifier associated with the tag (e.g. a unique serial number). More preferably, the RFID tag of the anti-tampering assembly is a NFC (Near Field Communication) passive tag.

A gateway device 40 running the anti-tampering application according to the present invention preferably comprises an RFID reader/writer (active or passive), more preferably an NFC reader/writer. The RFID and NFC technologies are known and hence they will not be further described herein after. The anti-tampering device and the gateway device 40 may be connected by the two-way radio communication that may be established between the RFID tag in the anti-tampering device and the RFID reader/writer in the gateway device 40. The gateway device 40 further preferably comprises an integrated circuit storing an identity number, for instance a SIM card, which can be used to identify and authenticate the gateway device 40 over the wireless communication network 30.

Figure 2:
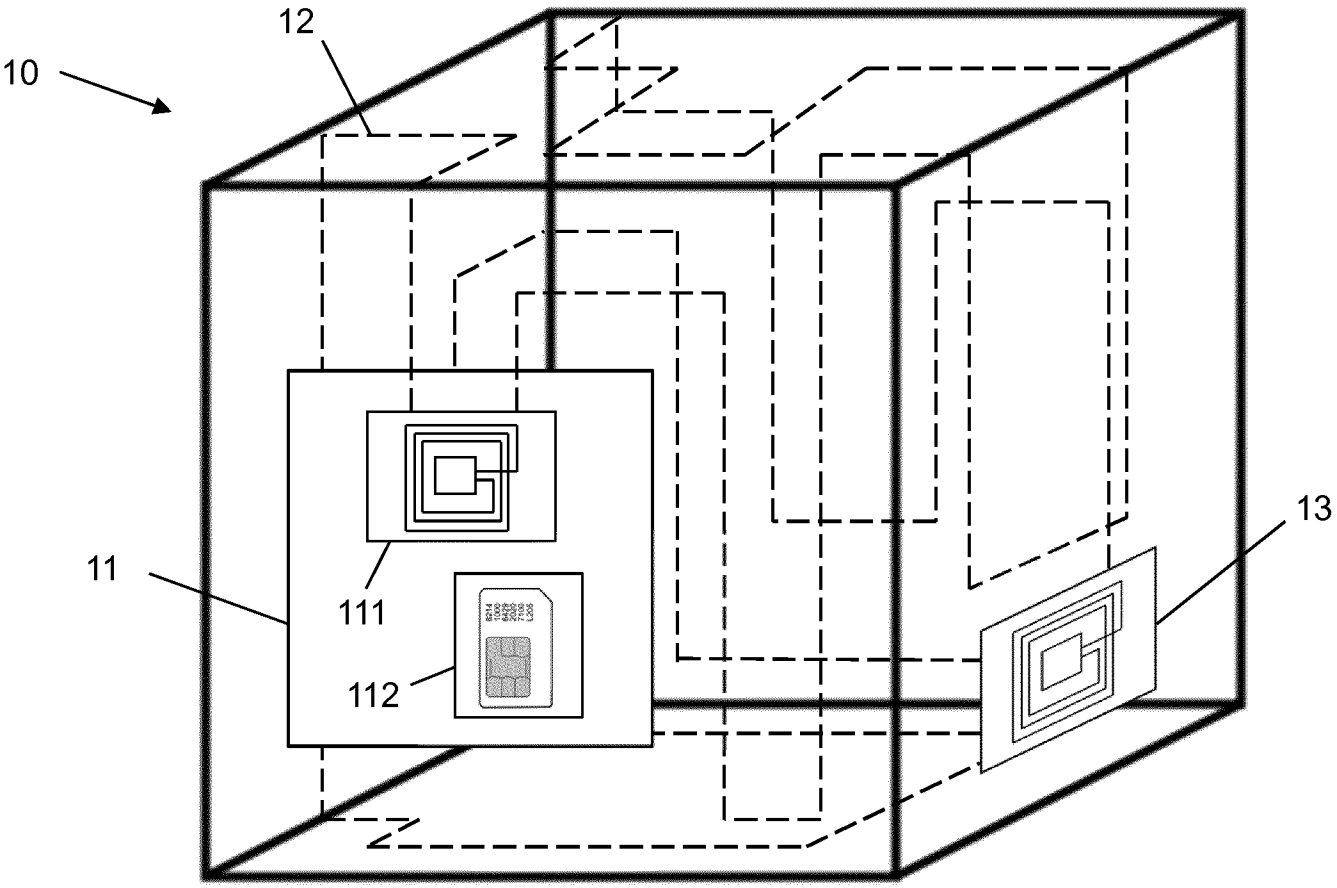
FIG. 2 schematically shows a package and an anti-tampering assembly according to embodiments of the present invention.

FIG. 2 schematically shows a box 10 provided with the anti-tapering assembly according to the present invention. The box 10 may be a carton box. The anti-tampering assembly preferably comprises a tampering detection unit, an actuating unit and an alarm unit. The tampering detection unit is preferably configured to detect any tampering of the box 10 (including any opening thereof). The actuating unit is preferably configured to actuate the alarm unit when a tampering is detected, while the alarm unit, upon actuation, is configured to generate an alarm, as it will be described in greater detail herein below.

The tampering detection unit preferably comprises a first portion and a second portion. The first portion of the tampering detection unit preferably comprises an RFID passive tag 111, which is more preferably an NFC passive tag, as already mentioned above. The first portion of the tampering detection unit, together with the actuating unit and the alarm unit, are housed in an anti-tampering device 11 configured to be attached on a wall of the box 10.

The anti-tampering device 11 is preferably in the form of a label to be applied on the inner surface of the box 10.

The second portion of the tampering detection unit comprises a tampering track 12 associated with the walls of the box and preferably provided on the inner surface of the box 10.

The tampering track 12 may comprise a conductive track that is printed with a conductive ink on the inner surfaces of the box 10, so that it is not visible from the outside of the box 10. The conductive tampering track 12 may be printed on the inner surfaces of the box 10 according to a pre-defined path, which is determined so that it topologically extends uniformly inside the box 10 to cover the inner surface of each wall of the box 10. Preferably, the path is determined in such a way that any possible (intentional or unintentional) tampering action applied on the box 10 (such as, for instance, cutting or tearing the material of the box, opening the box, and the like) will necessarily damage and interrupt the conductive tampering track 12. Moreover, the pre-defined path is also determined so as not to create any short-circuit between different portions of the conductive tampering track 12.

When the tampering assembly is assembled inside the box 10 before shipping, the tampering track 12 is preferably connected to the RFID tag 111 so that the operation (namely, the RFID functionalities) of the RFID tag 111 is inhibited. In particular, in this condition, an RFID reader can not read the unique identifier of the RFID tag 111 and any other information stored therein. In particular, this may be achieved by connecting the tampering track 12 to the RFID tag 111 so as to form a closed loop and to inhibit the operation of the antenna comprised in the RFID tag 111 by short-circuiting the antenna, as it will be described herein after. In the following description, the condition according to which the operation of the RFID tag 111 is inhibited will also be indicated as "the tampering track 12 short-circuits the RFID tag 111". The tampering track 12 may be connected to the RFID tag 111 by means of a conductive glue.

According to embodiments of the present invention, inside the box 10 to be shipped, the tampering track 12 and the RFID tag 111 form a closed path laid entirely on the inner surfaces of the box 10. The tampering track 12 may be connected to the RFID tag 111 before the box 10 is assembled for transportation. Moreover, the tampering track 12 advantageously covers also the edges of the box 10 in such a way that any attempt to tamper or open the box 10 in correspondence of any edge will inevitably cause the interruption of the tampering track 12. On the edges of the box 10 the tampering track 12 may be covered by an appropriate glue (e.g. a resin) so as to firmly adhere to the material of the box 10, even when the walls of the box 10 are folded. The tampering track 12 may be made to adhere to the box 10 in correspondence of the edges also by using clips or staples or the like. Using a strong glue to make the tampering track 12 to adhere to the box 10 advantageously determines that the tampering track 12 is inevitably interrupted when the box 10 is opened, which allows detecting a tampering event, as described in detail herein below.

According to an alternative embodiment, the path of the conductive tampering track 12 may be designed so that the loop comprising the conductive tampering track 12 and the RFID tag 111 is closed only when the box 10 is assembled for transportation. In this case, at least one portion of the tampering track 12 may be printed on an outer surface of the box 10 and a conductive contact may be created when the box 10 is closed for transportation.

According to embodiments of the present invention, the inner surfaces of the box 10 (and hence the tampering track 12 printed thereon) may be covered by an isolating film. In this way, the inner surfaces may be made resistant to scraping. Moreover, the presence of the isolating film advantageously avoids that short-circuits are created due to, for instance, the presence of metallic objects inside the box 10. Finally, the isolating film may protect the tampering track 12 especially at the edges of the box 10 when the material is folded.

FIG. 2 also schematically shows the alarm unit of the anti-tampering assembly, which is housed in the anti-tampering device 11 and is connected to the first portion of the tampering detection unit through the actuating unit (not shown in FIG. 2). The alarm unit preferably comprises a radio module 112. The radio module 112 is configured to support a radio technology for connecting to the wireless communication network 30. The radio technology is preferably one of: GSM, UMTS (Universal Mobile Telecommunications System), LTE, NB-IOT (Narrowband-Internet of Things).

Figure 3:
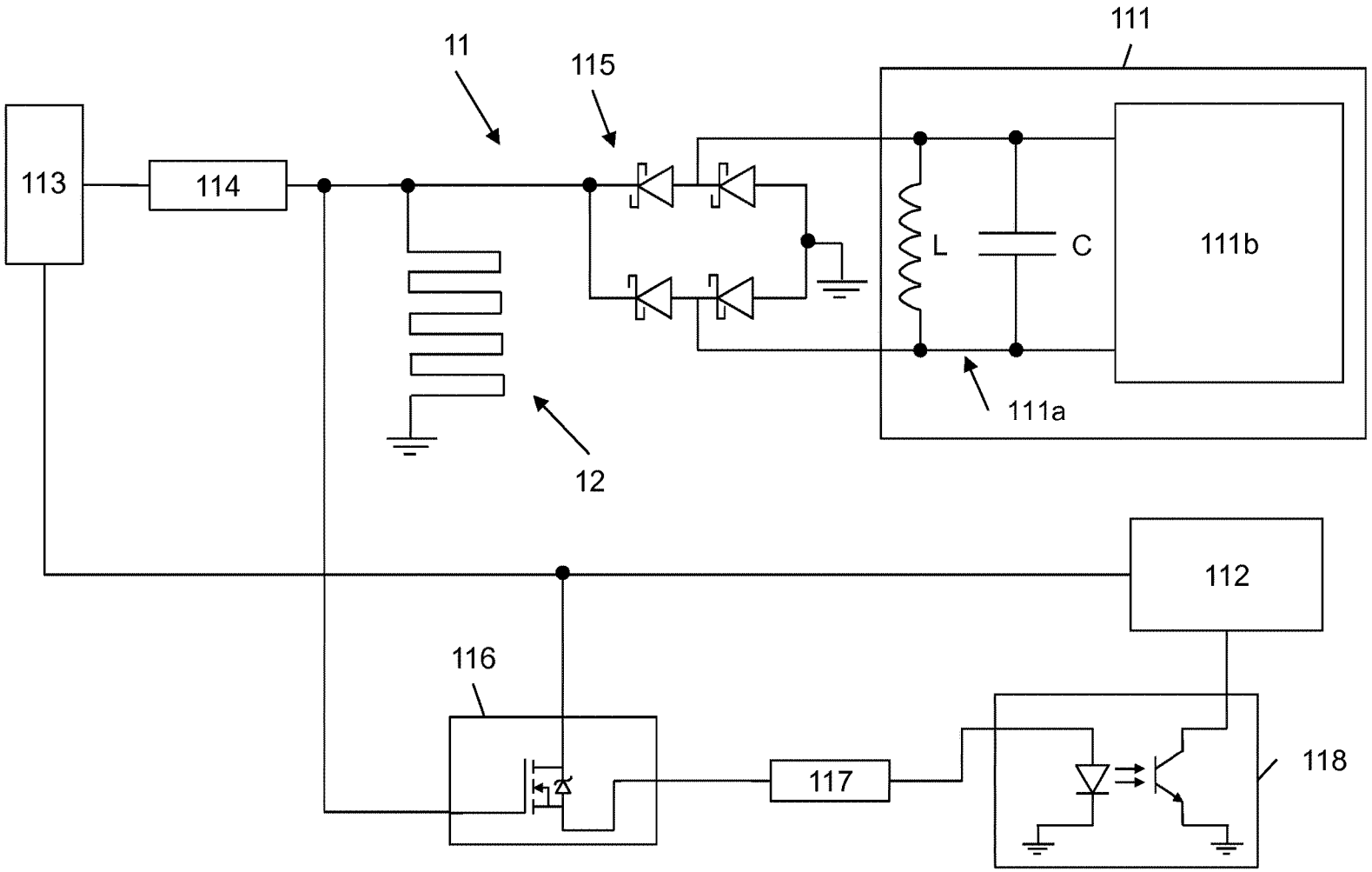
FIG. 3 shows a circuit diagram of an anti-tampering device according to embodiment of the present invention.

FIG. 3 is a detailed circuit diagram of the anti-tampering assembly according to embodiments of the present invention.

As shown in detail in FIG. 3, the RFID tag 111 of the first portion of the tampering detection unit preferably comprises a resonant circuit 111*a* and a further circuitry 111*b* comprising a memory. The memory of the RFID tag 111 stores the unique identifier associated with the RFID tag 111. The resonant circuit 111*a* comprises an antenna, e.g. a loop antenna, represented by an inductance L in FIG. 3, and a capacitor with capacitance C, in parallel with the antenna. The resonant frequency of the LC resonant circuit is the operating frequency of the RFID tag, and it depends on the values of the inductance L and the capacitance C. For instance, the inductance L may be equal to 2 μH, and the capacitance C may be equal to 68.9 pF: in this case, the resonant frequency is equal to 13.56 MHz.

As already mentioned above, when the anti-tampering assembly is installed in the box 10, the tampering track 12 short-circuits the antenna 111*a*, as represented in FIG. 3.

The anti-tampering device 11 preferably further comprises:

- a battery 113, configured to supply electricity to the components of the anti-tampering device 11. The voltage supplied by the battery 113 will be indicated as Vdd;
- a first resistance 114 having a first value R1, connected to the battery 113. The first resistance 114 may have a value R1 between about 10 MΩ and 100 MΩ, for instance equal to about 50 MΩ;
- two pairs of Schottky diodes 115 interposed in a bridge configuration between the tampering track 12 and the antenna of the RFID tag 111*a*, and connected to the battery 113 through the first resistance 114, as represented in FIG. 3. The Schottky diodes 115 have preferably very low junction capacitances, for instance lower than about 1 pF. According to these embodiments of the present invention, the value of the junction capacitance of the Schottky diodes 115 is selected so as not to modify the value of the capacitance C of the resonant circuit 111*a*, because otherwise the RFID tag 111 would not operate correctly. Indeed, the operating frequency of the RFID tag 111 depends on the value of the capacitance C and it shall be equal to the operating frequency of an RFID reader for establishing the proper communication between the two devices: if the capacitance of the resonant circuit 111*a* is altered, the communication with the RFID reader can not be established and the RFID tag 111 can not work properly.

The actuating unit of the anti-tampering device 11 preferably comprises a transistor 116, more preferably an N-MOSFET transistor, whose gate is connected to the tampering track 12. The actuating unit further preferably comprises an opto-isolator 118 connected to the transistor 116 through a second resistance 117 having a second value R2. The opto-isolator 118 is also connected to the radio module 112 of the alarm unit. The opto-isolator 118 comprises a light-emitting diode (LED). As it will be clearer from the following description, the opto-isolator 118 allows a current to pass through only in case the LED is switched on, which occurs when the tampering track 12 is interrupted and the transistor 116 starts conducting a current.

The radio module 112 preferably comprises an integrated circuit storing an identity number, preferably a SIM card storing, e.g., the MSISDN number, which can be used to identify and authenticate the anti-tampering assembly, in particular the anti-tampering device 11, over the wireless communication network 30. In the following description, for simplicity but without limitation, the integrated circuit storing an identity number of the radio module 112 will be indicated as "SIM card". The SIM card may be soldered to the circuit board of the radio module 112 or it may be virtually implemented in a secure integrated circuit. The radio module 112 further comprises a baseband module (which may comprise a memory), a transceiver and an antenna. The components of a radio module capable of connecting to a wireless communication network, such as a GSM network, are known and hence they will not be described in greater detail herein after.

When the anti-tampering assembly is installed in the box 10, the radio module 112 is not active. As it will be described in greater detail herein after, the radio module 112 is operated only when the box 10 is subject to tampering or it is opened.

The memory of the baseband module is preferably configured to store contact data of pre-defined contact entities that are preferably selected to receive possible alarms messages from the radio module 112, as it will be described herein after. The contact data preferably comprise one or more telephone numbers associated with the pre-selected entities, which may comprise: a number of the police, one or more numbers of the logistics service provider in charge of transporting or storing the box 10 (for instance the number of the logistics control center 50), number(s) pre-selected by the sender and/or the recipient of the box 10. The contact data may also be other types of data allowing to contact the pre-selected entities in case of alarm, such as e-mail addresses.

The alarm unit in the anti-tampering device 11 may optionally comprise an alarm circuit (not shown in FIG. 3) configured to provide an acoustic alarm. The optional alarm circuit may be connected in series with the opto-isolator 118 and in parallel with the radio module 112.

Further, the alarm unit in the anti-tampering device 11 may optionally comprise a GPS module configured to provide localization information. The optional GPS module may be connected in series with the opto-isolator 118 and in parallel with the radio module 112.

According to embodiments of the present invention, the anti-tampering assembly also comprises a tracking label 13. The tracking label 13 preferably comprises an RFID tag, more preferably an NFC tag. The RFID tag of the tracking label 13 is preferably a passive tag. The RFID tag of the tracking label 13 stores a unique identifier associated with it. The memory of the RFID tag of the tracking label 13 is preferably write-protected for improving security, e.g., password protected. This means that data can not be written or overwritten in the memory of the RFID tag of the tracking label 13 without using a password. The memory of the RFID tag of the tracking label 13 is preferably also password-protected from reading.

In the following lines, operation of the components of the anti-tampering assembly in case of a tampering event will be described.

In case of tampering of the box 10, the tampering track 12 of the tampering detection unit is interrupted. When the tampering track 12 is interrupted, the voltage Vdd supplied by the battery 113 is applied to the RFID tag 111. However, the presence of the Schottky diodes 115 avoids that the voltage Vdd supplied by the battery 113 is applied directly on the circuitry of the RFID tag 111, hence avoiding any damages to the RFID tag 111.

Moreover, the short-circuit over the antenna 111*a* is removed and the RFID functionalities of the RFID tag 111 are restored. As a consequence, an RFID reader can read the unique identifier of the RFID tag 111 and any other information stored in the memory thereof. Once interrupted, the tampering track 12 may operate as an antenna and it may amplify the signal of the RFID reader, which facilitates reading the data stored in the RFID tag 111.

Further, when the tampering track 12 is interrupted, a voltage is applied to the transistor 116 of the actuating unit so that the transistor 116 starts conducting and activates the alarm unit, which transmits an alarm message (for instance, in the form of an SMS message).

More in particular, when the tampering track 12 is interrupted, a voltage is applied to the gate of the transistor 116 through the first resistance 114, which guarantees that the transistor 116 actually starts conducting a current when the tampering track 12 is interrupted. The value R1 of the first resistance 114 preferably depends on the type of transistor 116 and is selected so as to maximize the time of discharge of the battery 113. The voltage applied to the gate of the transistor 116 causes a current to pass trough the transistor 116, thus generating a voltage on the source terminal of the transistor 116. The voltage on the source terminal of the transistor 116 is supplied to the opto-isolator 118 through the second resistance 117 so that the LED is switched on. The value R2 of the second resistance 117 is preferably chosen so as to provide the opto-isolator 118 with a supply voltage corresponding to the opto-isolator operating voltage. The opto-isolator 118 then supplies a voltage to the radio module 112, which is hence operated and it may connect to the wireless communication network 30. In particular, the radio module 112 may send the alarm message cited above to the entities associated with the contact data that are preferably stored in the baseband module of the radio module 112. The alarm message preferably provides data that may comprise:

- the identity number of the radio module 112, namely, the identity number stored in the SIM card (e.g. the MSISDN number);
- localization data indicating the location of the box 10 when the alarm is raised. Localization data may comprise an identifier of the cell of the wireless communication network 30 inside which the radio module 112 is located, or they may comprise GPS data provided by the optional GPS module of the alarm unit; and
- time data indicating the date and the time of the day at which the alarm is raised.

In the following description, the operation of the anti-tampering system 1 according to embodiments of the present invention will be described with reference to the use case mentioned above, involving the transportation and storage of goods from a point of origin to an end use destination.

According to an embodiment of the present invention, a logistics service provider whishing to use the anti-tampering system 1 described herein above, shall register to the anti-tampering service by installing the anti-tampering application on the gateway devices 40 of its operators and run the user interface of the web application on a web browser at the apparatuses of the logistics control center 50. Moreover, the identity numbers of the gateway devices 40 of the logistics service provider, as well as the identity numbers of the gateway devices 40 of carriers that may handle transportation and storage of the goods, shall be entered into a list of authorized identity numbers (also referred to as "white list") stored in the database of the server 20, i.e. a list of identity numbers stored in the SIM cards (e.g. the MSISDN numbers) of logistics service providers and carriers authorized to employ the anti-tampering system 1 for the transportation and storage of goods.

Upon registration to the anti-tampering service, an authentication procedure shall be set up in order to check the correctness of the authorized identity numbers. According to the present invention, the so-called "one time password" authentication procedure may be applied. This procedure comprises the following steps:

- the server 20 sends, to the gateway device 40 whose identity number is comprised in the white list, a message (e.g. an SMS message) containing an alphanumeric authentication code acting as a one-time password;
- the gateway device 40 receives the message containing the password and the holder of gateway device 40 inputs the password in a dedicated form of the anti-tampering application to authenticate the identity of the gateway device 40; and
- the server 20 sends to the gateway device 40 a token that is stored in the gateway device 40 and is associated with any further message sent by the gateway device 40.

In case of an agreement between the provider of the anti-tampering service and the mobile network operator providing connection to the wireless communication network 30, the above procedure is not necessary because the identity number can be checked any time the gateway device 40 communicates with the server 20. Indeed, the gateway device 40, in order to access the wireless communication network 30 for data communication, shall authenticate to a RADIUS (Remote Authentication Dial-In User Service) server of the wireless communication network 30, which provides an IP address to the gateway device 40 according to the RADIUS protocol. The check indicated above is then performed following the procedure below:

- the server 20 sends a request to a RADIUS server of the wireless communication network 30 indicating the IP address of the gateway device 40;
- the RADIUS server sends to the server 20 a message containing the identity number of the gateway device 40; and
- the server 20 checks whether the identity number of the gateway device 40 is comprised in the white list.

In case the communication between the gateway device 40 and the server 20 is based on SMS messages, no authentication procedure is required because the recipient receives the identity number of the gateway device 40 of the sender together with the SMS message.

Referring back to the use case considered in this description, a user whishing to secure the transportation and storage of goods through the system 1 shall register to the anti-tampering service by installing the anti-tampering application on a user gateway device 40 and send the identity number of the user gateway device 40 to the server 20 in order to put it in the list of authorized identity numbers stored in the database of the server 20. An authentication procedure such as the "one time password" authentication procedure shall be executed upon registration to the anti-tampering service, as already described above.

According to embodiments of the present invention, when a user requests to ship an item from a point of origin to an end use destination, an operator of the logistics service provider takes charge of the item and packages it in a box 10 provided with the anti-tampering assembly described above. Moreover, the operator preferably uses the web application 50 for creating a shipping record in the database cooperating with the server 20. The record is associated with the shipping of the box 10 and comprises data related to the shipping, the data comprising, preferably: the identity of the sender (e.g. name, surname and/or company name), the sender address (e.g. street, street number, city, zip code, country), the identity of the recipient (e.g. name, surname and/or company name), the destination address (e.g. street, street number, city, zip code, country), a shipping identifier. The data stored in the shipping record may also comprise the type of goods being shipped and a description of the item being shipped in the box 10. Before dispatching the box 10, the shipping identifier is coded into a shipping code that is preferably associated with the box 10 (e.g. printed on paper and glued on the box 10, or printed directly on the box 10). The shipping code may be an alphanumeric code, a barcode, a QR code or the like.

Then, before dispatching the box 10, an operator uses the anti-tampering application installed on her/his gateway device 40 to operate the RFID reader of the gateway device 40 to read the unique identifier associated with the RFID tag of the tracking label 13 (indicated in the following lines as "first RFID identifier"). The operator also uses the anti-tampering application installed on her/his gateway device 40 to operate the RFID reader of the gateway device 40 to read the unique identifier associated with the RFID tag 111 of the anti-tampering device 11 (indicated in the following lines as "second RFID identifier") in case the RFID tag 111 is readable before closing the box 10 (i.e. before the tampering track 12 is connected to the RFID tag 111). In case the RFID tag 111 is not readable before dispatching the box 10 (because, the RFID tag 111 and the tampering track 12 are already connected to form a closed loop before the box 10 is closed), the second RFID identifier may be acquired for instance by coding the second RFID identifier into a QR code or a barcode that may be applied on the anti-tampering device 11 and read by the gateway device 40 by means of a QR code or barcode reader.

Moreover, the gateway device 40 of the operator preferably acquires the shipping code. Acquiring the shipping code by the gateway device 40 may be performed by means of an appropriate reader, such as an OCR (Optical Character Recognition) reader, a barcode reader or a QR code reader.

Finally, before dispatching the box 10, the operator preferably acquires the identity number of the radio module 112. The identity number of the radio module 112 may be printed on the SIM card or on the anti-tampering device 11 or on a document associated with the SIM card and available to the operator. Hence, also the identity number of the radio module 112 may be acquired by the operator by means of an appropriate reader installed on the operator's user device or on another dedicated device, such as an OCR (Optical Character Recognition) reader, a barcode reader or a QR code reader. Alternatively, the operator may manually input the identity number of the SIM card of the radio module 112 into her/his device.

Then, the operator preferably uses the anti-tampering application on the gateway device 40 to send to the server 20 the first RFID identifier, the second RFID identifier, the identity number of the radio module 112, and context data that preferably comprise:

- an identifier of the gateway device 40, for instance the token received by the gateway device 40 from the server 20 upon authentication, which is associated with the identity number of the gateway device 40;
- localization data (for instance, identifier of the cell of the wireless communication network 30 in which the box 11 is located and/or GPS data);
- date and time of the day indicating when the first RFID identifier is read; and
- the shipping identifier.

According to an alternative embodiment of the present invention, the identifier of the gateway device 40 is the IP address of the gateway device 40 provided to the gateway device 40 by the RADIUS server of the wireless communication network 30.

The context data may also comprise the identity of the operator of the logistics service provider that assembles the box 10.

At the reception of the data from the gateway device 40, the server 20 preferably checks whether the identifier of the gateway device 40 corresponds to an identifier comprised in the list of authorized carriers.

In case the identifier of the gateway device 40 does not correspond to any identity number in the list of authorized carriers, the server 20 preferably generates and sends to the gateway device 40 a warning message, which may trigger the visualization of a warning indication on the user interface of the anti-tampering application in the gateway device 40 (as, for instance, a pop-up window). A warning indication may also be displayed on the user interface of the web application at the logistics control center 50. The warning message may be sent through the wireless communication network 30, in the form of, e.g., an SMS message, or as a notification of the anti-tampering application.

In case the identifier of the gateway device 40 corresponds to an identifier in the list of authorized carriers, the server 20 preferably stores the data received by the gateway device 40 in the database and in particular it associates these data with the shipping record related to the considered shipping. In this way, the unique identifier associated with the RFID tag of the tracking label 13, the unique identifier associated with the RDIF tag 111 of the anti-tampering device 11 and the identity number of the radio module 112 are associated with the context data, in particular with the shipping identifier.

Moreover, the server 20 sends to the gateway device 40 the data contained in the relevant shipping record. These data may comprise: the identity of the sender, the sender address, the identity of the recipient, the destination address, the type of goods, the description of the item(s) being shipped, the shipping identifier.

Then, the operator preferably uses the anti-tampering application on her/his gateway device 40 to operate the RFID writer to write the received data into the memory of the RFID tag of the tracking label 13. According to this embodiment, together with the data of the shipping record, the server 20 also sends to the gateway device 40 a password for enabling the gateway device 40 to write data in the memory of the RFID tag of the tracking label 13. Then, once the data are written in the memory of the RFID tag of the tracking label 13, the gateway device 40 preferably sends a confirmation message (e.g. in the form of a SMS message) to the server 20. Sending the confirmation message may be triggered by the operator using the anti-tampering application (e.g. pressing a button on the user interface). The server 20 in turn preferably sends an activation message to the gateway device 40, which may trigger the generation of an activation indication (e.g. a pop-up window) to be displayed on the user interface of the anti-tampering application, and this determines activating the shipping of the box 10.

It is to be noticed that writing the received data (comprising the identity of the recipient and the destination address) into the memory of the tracking label advantageously allows to minimize the usage of paper documents for shipping the box 10.

According to an alternative embodiment, the second RFID identifier and the identity number of the radio module 112 may be stored in the memory of the RFID tag of the tracking label 13. In this case, before the tampering track 12 is connected to the RFID tag 111, the operator may operate the gateway device 40 to read the first RFID identifier and then to send it to the server 20. At the reception of the data from the gateway device 40, the server 20 preferably checks whether the identifier of the gateway device 40 corresponds to an identifier comprised in the list of authorized carriers. If the identifier of the gateway device 40 corresponds to an identifier in the list of authorized carriers, upon reception of the first RFID identifier, the server 20 sends to the gateway device 40 a password for enabling the gateway device 40 to write data in the memory of the RFID tag of the tracking label 13. Then, the operator preferably uses the anti-tampering application on the gateway device 40 to operate the RFID writer to write the second RFID identifier and the identity number of the radio module 112 (which have been acquired as described above) into the memory of the RFID tag of the tracking label 13 by using the password received from the server 20.

Then, the operator may operate the gateway device 40 to read the first RFID identifier, the second RFID identifier and the identity number of the radio module 112 from the memory of the RFID tag of the tracking label 13 and to send them to the server 20 together with the context data. At the reception of the data from the gateway device 40, the server 20 preferably checks again whether the identifier of the gateway device 40 corresponds to an identifier comprised in the list of authorized carriers. In case the identifier of the gateway device 40 corresponds to an identifier in the list of authorized carriers, the server 20 preferably stores the data received by the gateway device 40 in the database and in particular it associates these data with the shipping record related to the considered shipping. Then, the operator preferably uses the anti-tampering application on her/his gateway device 40 to operate the RFID writer to write the data sent to the server 20 into the memory of the RFID tag of the tracking label 13, by using the password received from the server 20.

Then, as already described above, once the data are written in the memory of the RFID tag of the tracking label 13, the gateway device 40 preferably sends a confirmation message (e.g. in the form of a SMS message) to the server 20. The server 20 in turn preferably sends an activation message to the gateway device 40, which may trigger the generation of an activation indication (e.g. a pop-up window) to be displayed on the user interface of the anti-tampering application, and this determines activating the shipping of the box 10.

At the activation of the shipping of the box 10, the box 10 is handed over to a carrier for delivery. Upon reception of the box 10, the carrier preferably uses the anti-tampering application and the RFID reader of her/his gateway device 40 to detect readable RFID tags in the box 10. If the gateway device 40 of the carrier detects a single readable RFID tag (i.e. the RFID tag of the tracking label 13), the carrier determines that the box 10 is intact. If the gateway device 40 of the carrier detects that both the RFID tags of the box 10 (i.e. the RFID tag of the tracking label 13 and the RDIF tag 111 of the anti-tampering device 11) are readable, the carrier determines that a tampering event occurred. In this case, the carrier may send a warning message to the server 20 by using the anti-tampering application of her/his gateway device 40 (e.g. by pressing a button on the application user interface), and a warning indication (e.g. in the form of a pop-up window) may be displayed on the user interface of the web application at the logistics control center 50 of the logistics service provider. The warning message may be sent through the wireless communication network 30, in the form of, e.g., an SMS message, or as a notification of the web application. The carrier may also stop the shipping of the box 10.

Alternatively, the carrier may use the anti-tampering application of her/his gateway device 40 to contact an operator of the logistics service provider by sending an SMS message or establishing a phone call.

If the carrier determines that the box 10 is intact, she/he preferably uses the anti-tampering application and the RFID reader of the gateway device 40 to read the memory of the RFID tag of the tracking label 13. In particular, the RFID reader of the gateway device 40 reads the first RFID identifier and the shipping identifier stored in the memory of the RFID tag of the tracking label 13. Then, the gateway device 40 preferably sends to the server 20 the data read from the memory of the RFID tag of the tracking label 13, and a set of context data comprising:

- the identifier of the carrier's gateway device 40 (either the token associated with the identity number of the SIM card contained in the gateway device 40 or the IP address of the gateway device 40, as already described above);
- localization data (for instance, identifier of the cell of the wireless communication network 30 in which the gateway device 40 is currently located and/or GPS data);
- date and time of the day indicating when the first RFID identifier is read from the memory of the RFID tag of the tracking label 13.

The server 20 preferably checks whether the identifier of the gateway device 40 corresponds to an identity number in the list of authorized carriers stored in the database, as already described above. In the negative, a warning message is sent by the server 20, according to the procedure already described above.

If the identifier of the gateway device 40 corresponds to an identity number in the list of authorized carriers, the server 20 preferably uses the shipping identifier received from the gateway device 40 to interrogate the database and retrieve the data contained in the shipping record associated with the shipping identifier. Preferably, the server 20 compares the first RFID identifier received from the gateway device 40 with the value of the first RFID identifier stored in the shipping record (which corresponds to the value of the first RFID identifier stored in the database when the box 10 has been assembled for shipping and is associated with the shipping identifier). If the first RFID identifier received from the gateway device 40 does not correspond to the value of the first RFID identifier stored in the shipping record, the server 20 preferably sends a warning message to the gateway device 40 of the carrier, which may trigger the visualization of a warning indication (e.g. a pop-up window) on the user interface of the anti-tampering application. The warning message may be sent through the wireless communication network 30, in the form of, e.g., an SMS message, or as a notification of the anti-tampering application.

If the first RFID identifier received from the gateway device 40 corresponds to the value of the first RFID identifier stored in the shipping record, the server 20 preferably sends to the gateway device 40 of the carrier a confirmation message indicating that the first RFID identifier read by the gateway device 40 of the carrier is correctly associated with the shipping identifier. The confirmation message may be carried in a SMS message or it may be delivered to the gateway device 40 of the carrier in the form of a notification of the anti-tampering application.

Upon reception of the confirmation message, the carrier takes charge of the box 10 and shipping proceeds towards destination.

The procedures described above performed by the carrier (with her/his gateway device 40) and the server 20 are preferably repeated each time the box 10 is handed over to a different carrier or a different operator of a same carrier until delivery. The same procedures may be repeated each time the box 10 is put in storage in a storage area handled by the carrier or the logistics service provider and each time the box 10 leaves the storage area.

When the box 10 reaches the recipient, the end user uses the anti-tampering application and the user gateway device 40 to send a user confirmation message to the server 20, this message comprising the identifier of the user gateway device 40 and possibly localization data (for instance, identifier of the cell of the wireless communication network 30 in which the gateway device 40 is currently located and/or GPS data). If the end user does not have a gateway device 40 running the anti-tampering application, the user confirmation message above may be sent by the gateway device 40 of the carrier that reached the end user. The server 20 preferably checks whether the identifier of the user gateway device 40 (or the identifier of the carrier gateway device, in case the user is not able to operate a user gateway device) corresponds to an identity number in the list of authorized identity numbers stored in the database, as already described above. In the negative, a warning message is sent by the server 20, according to the procedure already described above.

Moreover, the server 20 may check whether the localization data sent by the gateway device 40 correspond to the destination address stored in the record is associated with the shipping of the box 10. In the negative, a warning message may be sent by the server 20 to the user gateway device 40 (or the carrier gateway device), so that a warning indication may be displayed through the user interface of the anti-tampering application running in the user gateway device 40 (or the carrier gateway device). A warning indication may also be displayed on the user interface of the web application at the logistics control center 50. In this case, further checks may be performed and the end user may accept the box conditionally or delivery may be cancelled. In any case, the actions to be taken in these cases shall be compliant with a policy foreseen in a shipping agreement between the service logistics provider and the end user.

If the identifier of the gateway device has a correspondence in the list of authorized identity numbers, the server 20 preferably sends to the gateway device 40 of the carrier that reached the end user an authorization message authorizing the carrier to deliver the box 10 to the end user. Finally, both the carrier and the end user, independently one from the other, may use the anti-tampering application and the respective gateway devices to send a delivery confirmation message to the server 20 to close shipping. Upon reception of the delivery confirmation messages from both the carrier and the end user, the server 20 preferably updates the shipping record associated with the considered delivery with an information indicating that shipping has been closed by the end user and the carrier.

In case the box 10 is subject to tampering during transportation or storage before delivery to the end user, the anti-tampering device 11 activates, as described above. The anti-tampering device 11 activates also when the box 10 is opened by the end user after shipping is closed. Then, the radio module 112 sends to the server 20 an alarm message. The alarm message preferably comprises:

- the identity number of the radio module 112 of the anti-tampering device 11;
- localization data indicating the current location of the box 10 (e.g. the identifier of the cell of the wireless communication network 30 where the box 10 is currently located or GPS data);
- date and time of the day.

Figure 4:
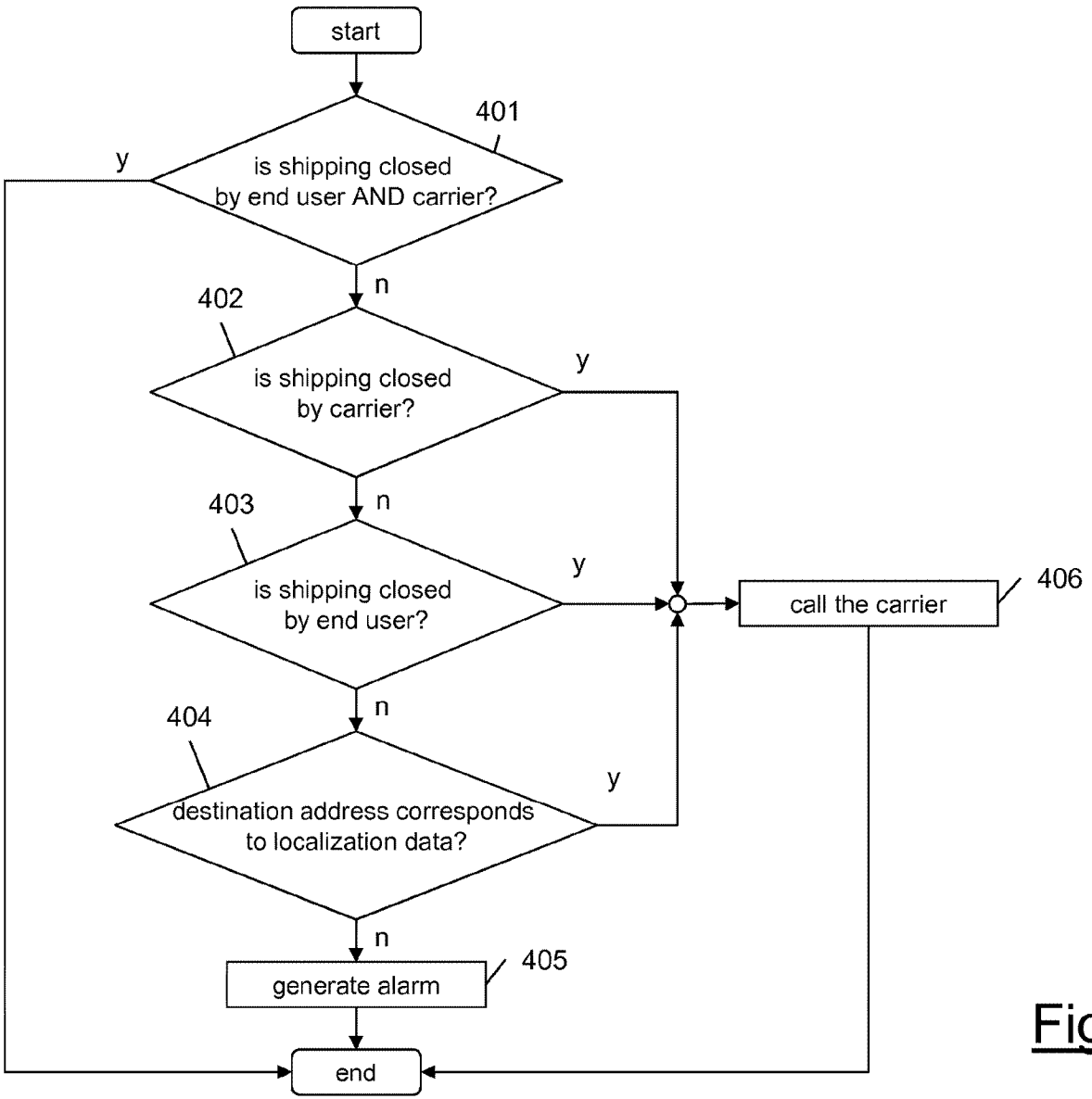
FIG. 4 is a flowchart of the steps of a procedure performed by a server of the anti-tampering system according to the present invention.

Preferably, when the server 20 receives the alarm message, it processes the received data in order to check whether a tampering event has actually occurred. The operations performed by the server 20 will be described in the following lines with reference to the flow chart of FIG. 4.

Upon reception of an alarm message, the server 20 preferably checks the shipping record of the database associated with the identity number contained in the alarm message. Then, the server 20 checks whether shipping has been closed by the end user and by the carrier (namely, the carrier who is currently handling the box 10) (step 401). In the affirmative, the server 20 ignores the alarm message.

In the negative, the server 20 preferably checks whether shipping has been closed either by the carrier (step 402) or by the end user (step 403). This situation may arise in case the end user or the carrier, respectively, forgot to close shipping after the box 10 has been correctly delivered to the end user. This check may be performed by the server 20 by checking whether a delivery confirmation message has been received from the carrier (step 402) or the end user (step 403). If the checks at steps 402 and 403 are both negative, the server 20 preferably checks whether the destination address of the box 10, which is stored in the relevant shipping record in the database, corresponds to the localization data contained in the alarm message (step 404). In the negative, it preferably generates an alarm (step 405). Then, the server 20 may send the alarm message (for instance, in the form of an SMS message) described above to the entities associated with the contact data that are preferably stored in the baseband module of the radio module 112. If any one of the checks at steps 402, 403 or 404 has a positive outcome, the server 20 may establish a contact with the carrier (namely, the carrier who is currently handling the box 10; in case of multiple carriers, this carrier is the last one having contacted the server 20) by, e.g. establishing a call from an operator of the logistics service provider to the carrier, in order to acquire more information about the shipping and verify whether the box 10 has correctly reached the end user.

It is to be noticed that even if the operation of the anti-tampering system 1 has been described by making reference to the presence of the tracking label 13, the presence of the tracking label is not essential for implementing the present invention. Indeed, as can be inferred from the description above, the operation of the components of the anti-tampering assembly (namely, the tampering detection unit, the actuating unit and the alarm unit) in case of a tampering event does not depend on the presence of the tracking label 13, which is hence not necessary to carry out the invention.

In the above description, reference has been made to a non limiting exemplary use case involving shipping of goods inside a box 10. As already mentioned, typically, carton boxes are used. However, according to other embodiments of the present invention, the anti-tampering assembly may be assembled in a fabric bag or pouch, which may be used to package valuable items such as watches, smartphones, tablets, bags or the like. The fabric may be made of natural and/or synthetic fibers or by a polymer. In this case, the tampering track may be made of an electrically conductive thread, whose path lays inside the fabric such that any tampering action on the package will inevitably cut the conductive wire. The ends of the electrically conductive thread are connected to the anti-tampering device 11 as already described above. The electrically conductive thread shall lay also on the edges of the package, wherein a glue may be applied to firmly fix the wire to the fabric edge. In this case, in the anti-tampering device 11, the RFID tag 111 may be a woven RFID label.

Advantageously, the present invention provides an anti-tampering assembly and an anti-tampering system for the transportation and storage of goods, which allow monitoring, in a complete and reliable way, the integrity of the goods' package, being the package either a carton box or a fabric bag. Indeed, the anti-tampering assembly may be associated with packages of any material, provided that the material does not shield the electromagnetic waves and let the RFID tag inside the package being read from outside. The present invention in particular allows to track the position of the package and get information about who is handling the package at any time between dispatching the package from its point of origin to delivery of the package to the end user. Tracking is precise and reliable. Moreover, the present invention allows to timely generate an alarm in case a tampering event (attempt to open the package or replacement of the package) is detected. Indeed, the present invention allows monitoring the integrity of the original package (i.e. the package that has been dispatched) thanks to the fact that a dedicated RFID tag is associated uniquely with the original package, the dedicated tag having the function of detecting any tampering event on the package itself. The tag also guarantees that the content of the package is securely transported as it is a passive tag which is not readable until the package is intact. Therefore it does not allow to get any information about the transported items.

Advantageously, the anti-tampering assembly is made with simple and reliable circuitries. Moreover, it does not require a long-life battery as the radio module activates only when a tampering event is detected and it shall operate only for a very limited interval of time to generate the alarm. The usage of simple circuitries and a short-life battery permits to largely reduce dimensions and costs with respect to known devices.

The invention claimed is:

1. An anti-tampering assembly for transportation and storage of a package, the anti-tampering assembly being configured to be associated with said package, the anti-tampering assembly comprising:

a tampering detection circuitry comprising a radio-frequency identification (RFID) tag and a tampering track of a conductive material electrically connected to said RFID tag so as to inhibit an operation of the RFID tag when the tampering track is intact upon dispatching said package, wherein the tampering track is configured to be interrupted in case of tampering of said package;

an actuating circuitry configured to detect interruption of said tampering track and, upon detecting the interruption, actuate an alarm circuitry; and the alarm circuitry comprising a radio circuitry configured to, upon actuation of the alarm circuitry, transmit an alarm message over a wireless communication network, wherein the RFID tag is a passive tag that comprises an antenna and a memory configured to store a unique identifier associated with said RFID tag, and wherein said tampering track is configured to, when the tampering track is not interrupted, short-circuit said antenna.

2. The anti-tampering assembly according to claim 1, wherein said RFID tag is a Near Field Communication (NFC) passive tag.

3. The anti-tampering assembly according to claim 1, wherein said package is a box and said tampering track is a conductive track of a conductive ink to be printed on inner surfaces of said box.

4. The anti-tampering assembly according to claim 1, wherein said RFID tag of said tampering detection circuitry, said actuating circuitry, and said alarm circuitry are housed in an anti-tampering device comprising a battery.

5. The anti-tampering assembly according to claim 4, wherein said anti-tampering device is in the form of a label to be applied on an inner surface of said package.

6. The anti-tampering assembly according to claim 4, wherein said anti-tampering device further comprises two pairs of Schottky diodes interposed in a bridge configuration between said tampering track and said RFID tag, and connected to said battery.

7. The anti-tampering assembly according to claim 1, wherein said actuating circuitry comprises:

an N-MOSFET transistor, a gate of the N-MOSFET transistor being electrically connected to said tampering track; and an opto-isolator electrically connected to said N-MOSFET transistor and to said radio circuitry.

8. The anti-tampering assembly according to claim 1, wherein said radio circuitry comprises:

an integrated circuit configured to store an identity number to identify the anti-tampering assembly over said wireless communication network; and a baseband circuitry configured to store data of at least one pre-defined contact entity, wherein said radio circuitry is configured to, in case of the tampering track being interrupted, send the alarm message to said at least one pre-defined contact entity.

9. The anti-tampering assembly according to claim 8, wherein said alarm message comprises said identity number of said radio circuitry, localization data indicating a current location of said package and time data indicating a date and a time of the day at which said alarm message is sent.

10. The anti-tampering assembly according to claim 1, further comprising a tracking label that includes a further RFID tag, said RFID tag being associated with a first unique identifier, and said further RFID tag being associated with a second unique identifier.

11. The anti-tampering assembly according to claim 1, wherein said package is a fabric bag or pouch, and said tampering track is an electrically conductive thread of said fabric bag or pouch.

12. An anti-tampering system for transportation and storage of a package, the anti-tampering system comprising an anti-tampering assembly configured to be associated with said package according to claim 1, and a server communicatively connected to said anti-tampering assembly over a wireless communication network, said server being configured to cooperate with a database configured to store a shipping record associated with the transportation and storage of said package, said system further comprising an anti-tampering application configured to be installed on a gateway device configured to interact with the server via said wireless communication network.

13. The anti-tampering system according to claim 12, further comprising a further RFID tag, wherein said shipping record comprises a first unique identifier associated with said RFID tag, a second unique identifier associated with said further RFID tag, an identity number of said radio circuitry, and a shipping identifier associated with said package.

14. The anti-tampering system according to claim 12, wherein said database is configured to store a list of authorized identity numbers associated with a number of gateway devices authorized to handle the transportation and storage of said package.

15. The anti-tampering assembly according to claim 1, wherein the RFID tag includes a first terminal and a second terminal, the antenna being electrically coupled between the first terminal and the second terminal, the tampering track is electrically connected between a third terminal and a ground terminal, and the tampering detection circuitry further comprises a bridge circuitry electrically connected to the first terminal, the second terminal, and the third terminal, the tampering track and the bridge circuitry being configured to form a short-circuit between the first terminal and the second terminal to inhibit the operation of the RFID tag when the tampering track is not interrupted, and remove the short-circuit between the first terminal and the second terminal to restore the operation of the RFID tag when the tampering track is interrupted.

16. The anti-tampering assembly according to claim 15, wherein the bridge circuitry comprises:

a first diode electrically connected between the ground terminal and the first terminal;

a second diode electrically connected between the first terminal and the third terminal;

a third diode electrically connected between the ground terminal and the second terminal; and a fourth diode electrically connected between the second terminal and the third terminal.

17. The anti-tampering assembly according to claim 1, wherein said actuating circuitry is configured to:

turn off a current path that powers the alarm circuitry in response to the tampering track being intact; and turn on the current path that powers the alarm circuitry in response to the tampering track being interrupted.

* * * * *